US008531813B2

(12) United States Patent
Samila

(10) Patent No.: US 8,531,813 B2
(45) Date of Patent: Sep. 10, 2013

(54) METHOD AND SYSTEM FOR MOVING MATERIAL

(75) Inventor: John Samila, Porter, IN (US)

(73) Assignee: Ephaugh, Inc., Westmont, IL (US)

( * ) Notice: Subject to any disclaimer, the term of this patent is extended or adjusted under 35 U.S.C. 154(b) by 128 days.

(21) Appl. No.: 13/110,775

(22) Filed: May 18, 2011

(65) Prior Publication Data

US 2011/0286140 A1 Nov. 24, 2011

Related U.S. Application Data

(60) Provisional application No. 61/346,293, filed on May 19, 2010.

(51) Int. Cl.
*H01H 47/00* (2006.01)

(52) U.S. Cl.
USPC ..... 361/139; 361/144

(58) Field of Classification Search
USPC ..... 361/139–144
See application file for complete search history.

(56) References Cited

U.S. PATENT DOCUMENTS 3,629,663 A 12/1971 Butkus
3,965,394 A * 6/1976 Heinzman ..... 361/97
4,306,268 A 12/1981 Cooper
4,600,964 A 7/1986 Ela et al.
5,813,712 A * 9/1998 Mozelt ..... 294/65.5
7,697,253 B1 4/2010 Maraval
2008/0068772 A1 3/2008 Kubo et al.
2011/0148204 A1* 6/2011 DiMarco et al. ..... 307/65

OTHER PUBLICATIONS

International Search Report for related International Application No. PCT/US2011/037024.

* cited by examiner

*Primary Examiner* — Danny Nguyen
(74) *Attorney, Agent, or Firm* — Factor Intellectual Property Law Group, Ltd.

(57) ABSTRACT

A method and system for moving magnetic material includes an electromagnet wherein known problems associated with DC power circuit interruptions are substantially reduced. The system includes a generator coupled to an electromagnet, the generator being powered by a power supply through a first set of contactors which are configured to open and close a first circuit between the power source and the generator coupled to the magnet to start and stop a lifting sequence, wherein the first circuit includes a first bridge rectifier, a reactance element, and a first resistance element. The system includes a second set of contactors configured to open and close a second circuit between the power source and the generator coupled to the magnet to start and stop a dropping sequence, wherein the second circuit includes a second bridge rectifier and at least one pair of contactors for discharging power from the generator, the at least one pair of contactors being configured to open and close a discharge circuit between at least the reactance element and the generator.

37 Claims, 5 Drawing Sheets

METHOD AND SYSTEM FOR MOVING MATERIAL

RELATED APPLICATIONS

This application claims priority to U.S. Provisional Application No. 61/346,293 filed on May 19, 2010 the entirety of which is incorporated herein by reference.

FIELD OF THE INVENTION

The present invention relates generally to the field of lifting devices and more specifically, to a method and system utilizing an electromagnet for attaching, moving, and releasing magnetic material.

BACKGROUND OF THE INVENTION

The material handling industry utilizes a variety of mechanisms to lift, move, and place materials such as scrap or finished products. For relocating magnetic materials, e.g., diamagnetic metals, paramagnetic metals, and ferromagnetic metals; an electromagnet is preferable in many cases because it does not require personnel to position the chains, hooks, and other mechanical grasping mechanisms often utilized during the attachment and release of the magnetic material. Such grasping mechanisms can further mar metal surfaces and increase the possibility of product damage.

One drawback to using an electromagnetic lifting device is that the magnetic material may not be readily released by the electromagnet when its power source is removed. For instance, when the power source to the electromagnet is removed, the magnetic material will not immediately be released, but will eventually drop due to the force of gravity. As such, it is common to temporarily reverse the polarity of the electromagnet to repel or "push" the magnetic material from the electromagnet. The magnitude of the reverse charge can be significant and as a result, some magnetic materials—e.g., ferromagnetic—may be re-attracted to the now oppositely charged electromagnet and not drop; or if released, will retain an undesired residual magnetism.

An additional concern when using an electromagnetic lifting device is the discharge and consumption of any power stored within the device after lifting and/or dropping a magnetic material. Any power stored within the device must be discharged and consumed before a generator circuit can be opened and/or reversed to drop a lifted material or pick up a new piece of material. Such is particularly true if DC power is provided to the generator because of the known destructive issues of DC power circuit interruption. As such, it would be advantageous to develop a method which quickly and efficiently discharges and consumes all power stored in the field generator allowing in a manner which fully eliminates any concerns associated with the interruption of a DC power circuit.

The present invention is provided to solve these and other issues.

SUMMARY OF THE INVENTION

Accordingly, the present invention is directed toward a method and apparatus for moving material that utilizes an electromagnet operatively coupled to a voltage generator.

According to one aspect of the invention a system and controller for lifting, moving, and dropping material is provided. The system receives power from a DC power supply and includes a DC-to-AC converter or inverter connected to a primary winding of a transformer. During a lifting sequence, a first set of contactors is closed permitting the secondary winding of the transformer to form a first circuit with a generator. The first circuit includes a first bridge rectifier, a reactance element, a resistance element, and the first set of contactors.

According to another aspect of the invention, once the lifting sequence is complete, a first pair of contactors may be closed. Once the first pair of contactors is closed, the first set of contactors may be safely opened, disconnecting the generator from the DC power supply and thereby terminating the lifting sequence. Closing the first pair of contactors forms a circuit between the generator and the reactance element, allowing residual voltage stored in and/or created by the generator to be discharged, consumed and/or negated. Once the power in the generator is discharged and consumed, the first pair of contactors may be safely opened.

According to another aspect of the invention, in order to drop materials lifted during the lifting sequence after all the residual voltage from the generator has been discharged, consumed and/or is negated, a second set of contactors may be closed, permitting the secondary winding of the transformer to form a second closed circuit with the generator. The second circuit includes a second full-wave bridge rectifier, and may additionally include the reactance element or a second reactance element, the resistance element or a second resistive element, and the second set of contactors.

According to another aspect of the invention, once the dropping sequence is complete, a second pair of contactors may be closed. Once the second pair of contactors is closed, the second set of contactors may be safely opened, disconnecting the generator from the DC power supply and thereby terminating the dropping sequence. Closing the second pair of contactors forms a circuit between the generator and the reactance element or the second reactance element, allowing power stored in the generator to be discharged, consumed, and/or negated. Once the power in the generator is discharged and consumed, the second pair of contactors may be safely opened, and a new lift sequence may begin.

According to another aspect of the invention, a rectifier may be connected in series with at least one contactor in either the first or second pair of contactors.

According to one aspect of the invention a system and controller for lifting, moving, and dropping material is provided. The system is powered by a DC power supply and comprises a DC-to-AC converter or inverter connected to a primary winding of a transformer. During a lifting sequence, a first set of contactors is closed permitting the secondary winding of the transformer to form a first circuit with a generator, the first circuit further including a first bridge rectifier, a reactance element, a resistive element, and the first set of contactors. Once the lifting sequence is complete, the first set of contactors may be opened, terminating the lifting sequence. In order to drop materials lifted during the lifting sequence, during the dropping sequence, a second set of contactors are closed to start a dropping sequence, the second set of contactors permitting the secondary winding of the transformer to form a second circuit with the generator, the second circuit including a second full-wave bridge rectifier, the reactance element, the resistive element, and the second set of contactors. Once the dropping sequence is complete, the second set of contactors may be opened, terminating the dropping sequence. During either the lifting or dropping sequence, the generator powers an electromagnet that is used for lifting and transporting magnetic materials.

According to another aspect of the invention, after the lifting and dropping sequences have been completed and both the first and second set of contactors are opened, a pair of contactors is closed. Closing the pair of contactors forms a third circuit between the generator and the reactance element wherein any residual output voltage created by the armature is consumed and/or negated by the reactance element until the lift sequence begins again. The pair of contractors should remain closed until the next lift sequence is started, at which time the pair of contactors are opened and the first set of contactors are once again closed.

According to one aspect of the invention, a method for lifting, moving, and/or dropping magnetic material is provided. During the lifting sequence, the method comprises the steps of closing a first set of contactors, allowing power from a DC power supply to be supplied to a generator through a DC-to-AC converter or inverter, a transformer, a first bridge rectifier, a resistance element, and a reactance element. Once the magnetic material is lifted, a dropping sequence may begin wherein the first set of contactors are opened and a second set of contactors are closed, allowing power from a DC power supply to be supplied to a generator through the inverter, the transformer, a second bridge rectifier, the resistance element and a reactance element. Once the dropping sequence is completed, the second set of contactors is opened and a first pair of contactors is closed. The first pair of contactors closes a circuit between the generator and the reactance element. Forming the circuit between the generator and the reactance element allows for any residual voltage created by the armature in the generator to be consumed and/or negated by the reactance element.

According to one aspect of the invention, a method for lifting, moving, and/or dropping magnetic material is provided. During the lifting sequence, the method comprises the steps of closing a first set of contactors, allowing power from a DC power supply to be supplied to a generator through a DC-to-AC converter or inverter, a transformer, a first bridge rectifier, a resistance element, and a reactance element. Once the magnetic material is lifted, a first pair of contactors is closed, forming a circuit between the generator and the reactance element. After closing the first pair of contactors, the first set of contactors may be safely opened, disconnecting the DC power supply. Once the first pair of contactors is closed and the DC power supply is disconnected, any residual voltage stored and/or created in the generator may be consumed and/or negated by the reactance element.

According to another aspect of the invention, once the power stored in the generator during the lifting sequence is discharged and consumed, the first pair of contactors may be opened, and a second set of contactors may be closed to drop the lifted material. During the dropping sequence, the method comprises the steps of closing the second set of contactors, allowing power from a DC power supply to be supplied to a generator through the DC-to-AC converter or inverter, the transformer, a second bridge rectifier, a resistance element, and a reactance element. Once the magnetic material is dropped, a second pair of contactors is closed, forming a circuit between the generator and the reactance element. After closing the second pair of contactors, the second set of contactors may be safely opened, disconnecting the DC power supply. Once the second pair of contactors is closed and the DC power supply is disconnected, any residual voltage stored and/or created in the generator may be consumed and/or negated by the reactance element.

According to another aspect of the invention, the reactance element in the second circuit may be identical to the reactance element used during the lift sequence.

According to another aspect of the invention, once the power stored in the generator during the dropping sequence is discharged and consumed, the second pair of contactors may be opened, and a new lift sequence may be started. The lift sequence may be started to either lift a new piece of magnetic material or remove any residual magnetism from the dropped material.

It is to be understood that the aspects and objects of the present invention described above may be combinable and that other advantages and aspects of the present invention will become apparent upon reading the following description of the drawings and detailed description of the invention.

DETAILED DESCRIPTION OF THE PRESENT INVENTION

Figure 1:
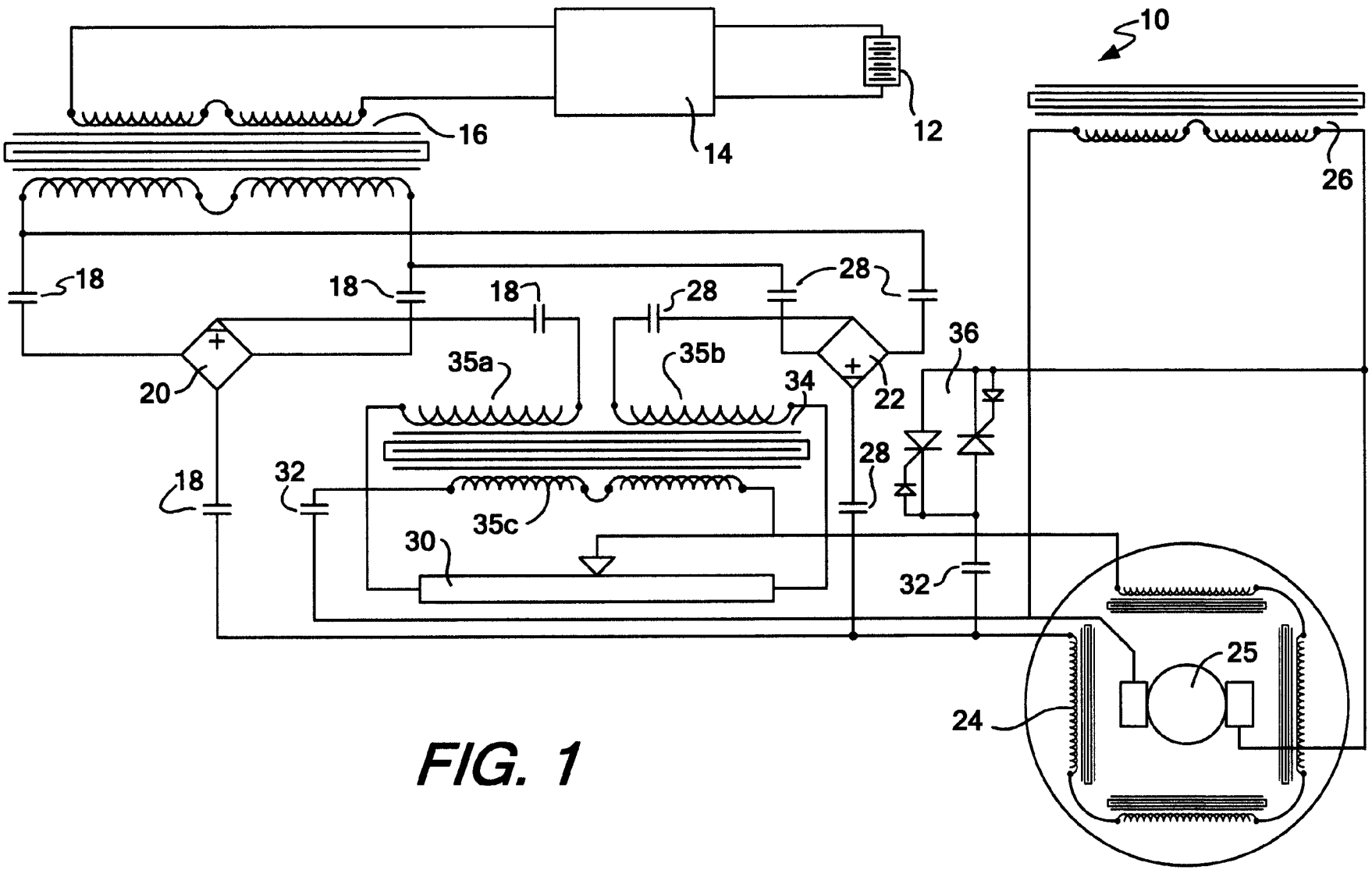
FIG. 1 is a schematic diagram of an embodiment of a magnetic controller for a material handling device in accordance with the present invention.

While this invention is susceptible to embodiments in many different forms, there is shown in the drawings and will herein be described in detail, preferred embodiments of the invention with the understanding that the present disclosures are to be considered as exemplifications of the principles of the invention and are not intended to limit the broad aspects of the invention to the embodiments illustrated.

Figure 2:
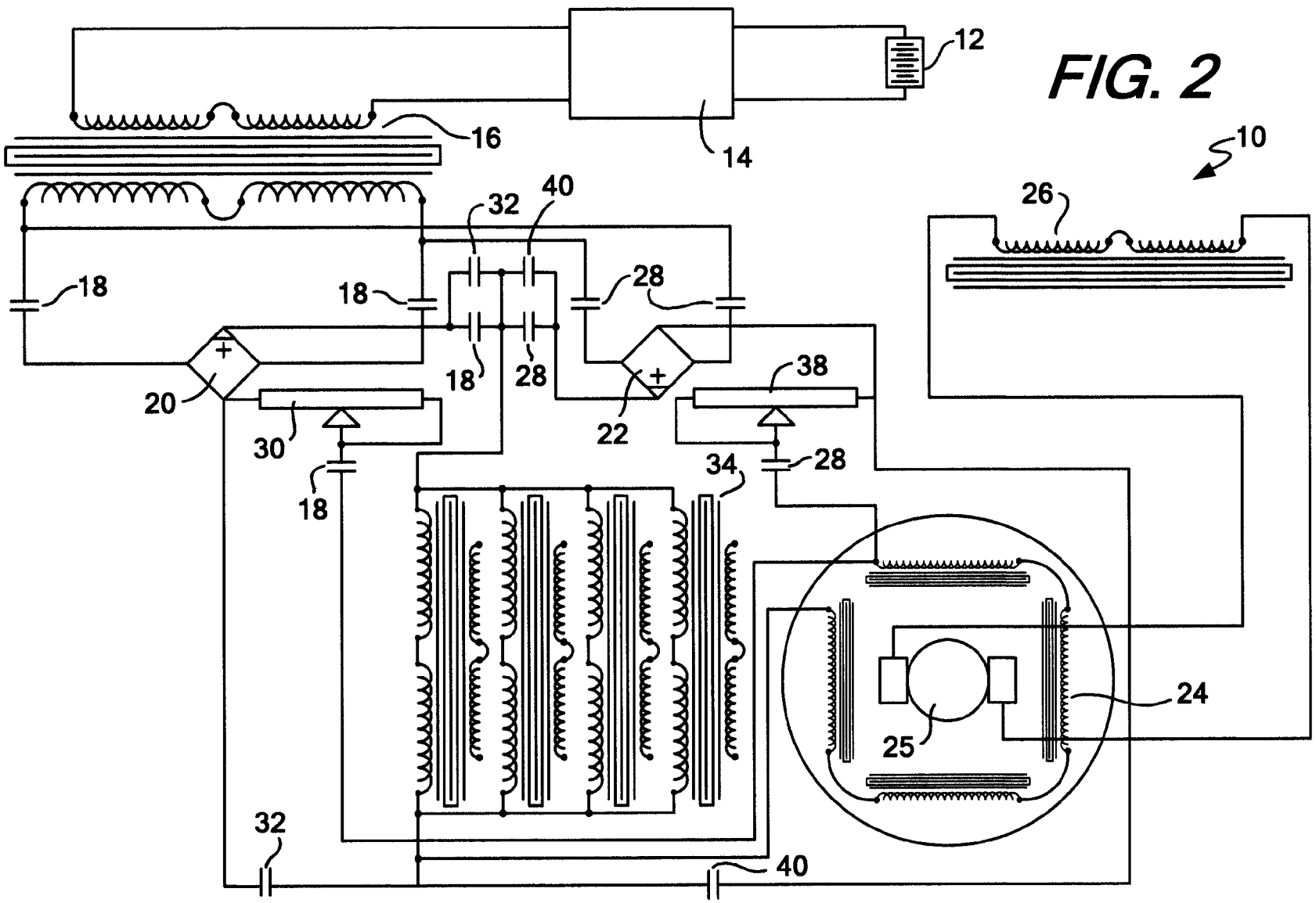
FIG. 2 is a schematic diagram of an embodiment of a magnetic controller for a material handling device in accordance with the present invention.
Figure 3:
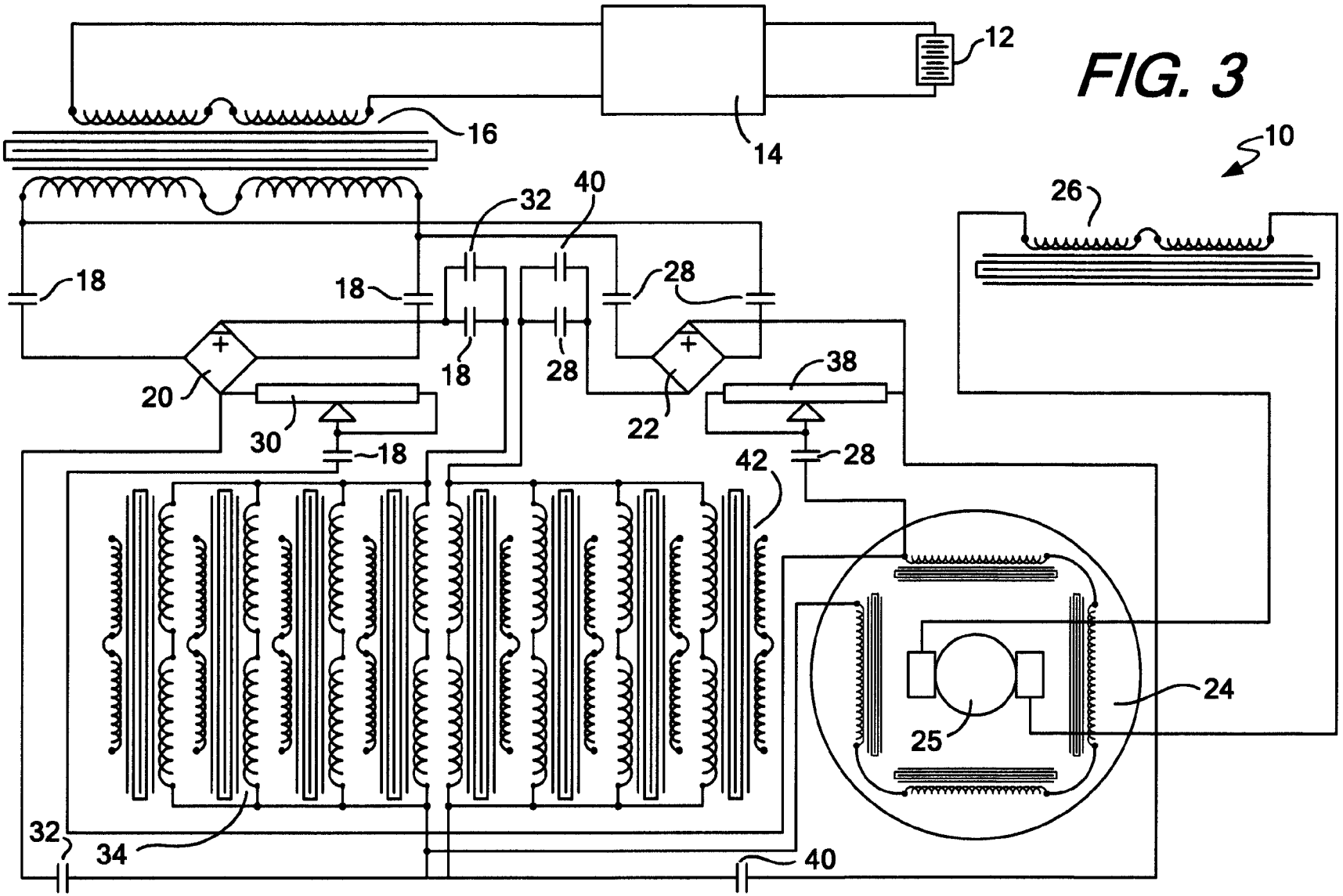
FIG. 3 is a schematic diagram of an embodiment of a magnetic controller for a material handling device in accordance with the present invention.

FIGS. 1-3 are embodiments of the present invention, each including a system 10 having power supply 12 providing power to a controller having inverter or DC-to-AC converter 14, transformer 16, first set of contactors 18, first bridge rectifier 20, second bridge rectifier 22, generator 24 including armature 25, magnet 26, second set of contactors 28, resistor 30, a first pair of contactors 32, and reactance element 34. Alternatively, generator 24 and magnet 26 may be provided separate from and attached to the output of the controller.

As seen in FIG. 1, in some embodiments system 10 may further include rectifier 36 to facilitate the consumption and/or negating armature voltage when system 10 is in an "off" state, i.e. not lift or dropping material. Other embodiments, as shown in FIG. 2, may include second resistor 38 and second pair of contactors 40. Other embodiments, like that seen in FIG. 3, may further include second reactance element 42 in addition to reactance element 34.

Regardless of which embodiment is selected, power supply 12, which ultimately provides voltage to generator 24, is preferably a DC power supply, like for example a 12V battery, and supplies voltage to DC-to-AC converter or inverter 14. DC-to-AC converter or inverter 14 is connected to the primary winding 40 of transformer 16 which may capable of stepping the converted AC voltage up or down.

Reactance elements 38 and 39 may be any element capable of negating and/or consuming the energy stored in generator 24 during the lifting and/or dropping sequence in a preferred embodiment may be, for example, a control transformer sized to the load. For example, the fields of a 5 kW generator requires approximately 0.66 A. In order to match this load, a 0.250 kVA control transformer having a dual voltage primary (240/480) and a dual voltage secondary (120/240) may be used.

Figure 4:
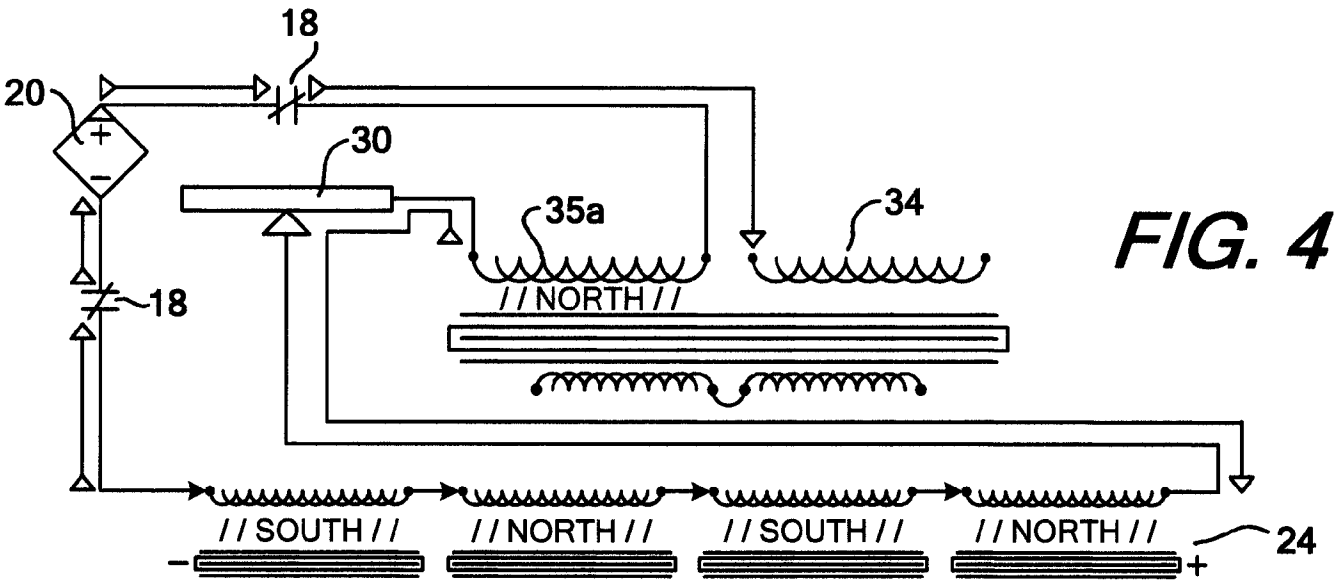
FIG. 4 is a schematic diagram showing a portion of a first circuit as contemplated by the embodiment shown in FIG. 1.

For each embodiment, system 10 operates as follows during the lift sequence. First set of contactors 18 each close, completing a first circuit between voltage source 12 and generator 24 coupled to magnet 26. An example of a portion of the first circuit can be seen in FIG. 4, which shows the portion of the first circuit from first rectifier 20 to generator 24 for the embodiment shown in FIG. 1. As should be appreciated by those having skill in the art, the first circuit for the embodiments shown in FIGS. 2 and 3 are substantially similar and operate in a similar manner.

Once set of contactors 18 are closed, power supply 12 provides a first DC voltage to DC-to-AC converter or inverter 14, which converts the DC voltage to AC voltage and provides the AC voltage to transformer 16. The first AC voltage provided to the transformer 16 is then stepped-up (or stepped-down) to a second AC voltage, and provided to first rectifier 20 through any contactors 18 connected in series between transformer 16 and first rectifier 20. After the AC voltage is rectified, the resulting DC voltage is provided to generator 24 through first coil 35*a* of reactance element 34 and resistance element 30. Once the DC voltage is received by generator 24, magnet 26 is powered and material may be lifted by the system. The first circuit is then completed, and current is returned to generator 22, through contactors 18 to first rectifier 20 and ultimately transformer 16.

As can be seen in FIGS. 2 and 3, resistance element 30 may be alternatively located in the return path from generator 24 to first rectifier 20, and current may flow through the entire reactance element, not a single coil as shown in FIG. 1. Additionally, in other alternative embodiments, reactance element 34 may likewise be provided in the return path from generator 24 to first rectifier 20.

Figure 5:
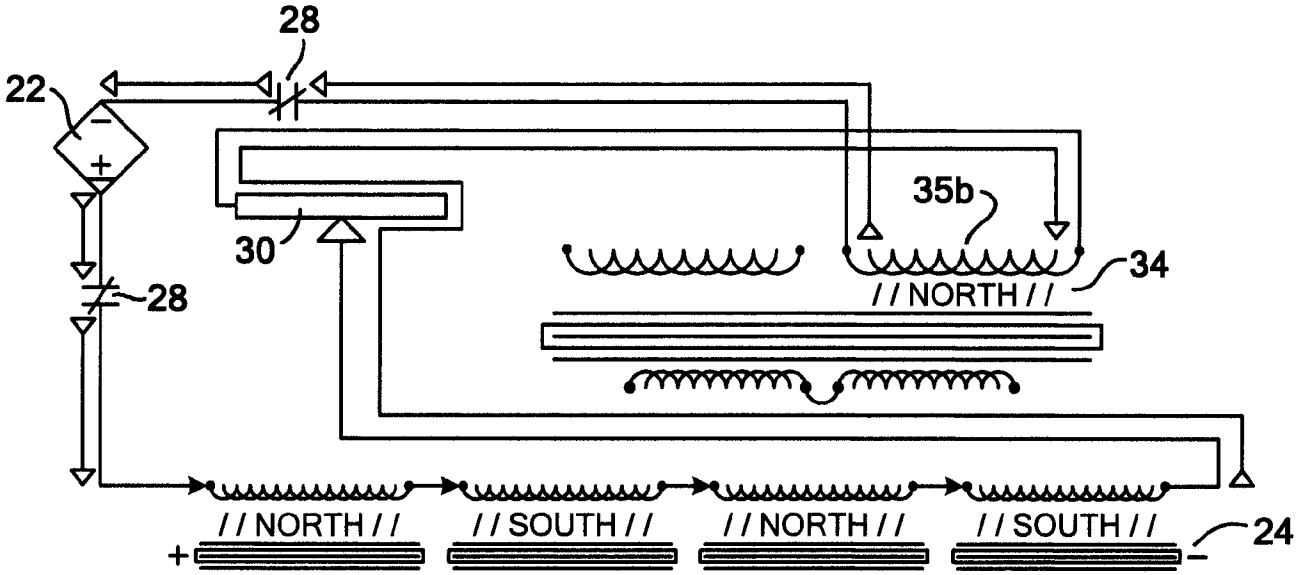
FIG. 5 is a schematic diagram showing a portion of a second circuit as contemplated by the embodiment shown in FIG. 1.

After material has been lifted, to drop magnetic material that has been lifted by the electromagnet, first set of contactors 18 are opened and second set of contactors 28 are closed, completing a second circuit between power supply 12 and generator 24 and magnet 26. An example of a portion of this circuit can be seen in FIG. 5, which shows the second circuit from second rectifier 22 to generator 24 for the embodiment shown in FIG. 1. As should be appreciated by those having skill in the art, the closed circuit for the embodiments shown in FIGS. 2 and 3 are substantially similar to that shown in FIG. 5 and operate in a similar manner.

As during the lift sequence, during the drop sequence, power supply 12 provides a first DC voltage to DC-to-AC converter or inverter 14, which converts the DC voltage to AC and provides the voltage to transformer 16. The first AC voltage provided to the transformer 16 is then stepped-up (or stepped-down) to a second AC voltage and is provided to second bridge rectifier 22 through either of contactors 28. After the AC voltage is rectified, in the embodiment shown in FIG. 1, the resulting DC voltage is provided to generator 24 through contactor 28 and returned to second rectifier 22 and ultimately transformer 16 through resistance element 30, second coil 35*b* of reactance element 34, and contactor 28. Once the DC voltage is received by generator 24, power is provided to magnet 26, and material that was previously lifted may be dropped. As should be appreciated by those having ordinary skill in the art, in order to drop materials, the second circuit should provide power to generator 24 in a manner which reverses the polarity of magnet 26 from the lifting sequence.

In alternative embodiments, like those shown in FIGS. 2 and 3, the second circuit formed during the drop sequence may also include additional circuit components, like for example, second resistor 38 (seen in FIGS. 2 and 3) and/or second reactance element 42 (seen in FIG. 3). As with the embodiment shown in FIG. 1, in each alternative embodiment, the second circuit includes second set of contactors 28, second rectifier 22, generator 24, a resistance element, and a reactance element. As with the first circuit closed during the lift sequence, it should be appreciated by those having ordinary skill in the art that the placement of resistance element 30 or 38 and reactance element 34 or 42 is unimportant so long as the second circuit contains a resistance element and a reactance element. It should also be appreciated by those having ordinary skill in the art that whether or not one or two reactance elements are used, current may flow through the entire reactance element rather than a single coil during the dropping sequence.

In the embodiment shown in FIG. 1, once a material has been lifted and dropped, in order to prevent the many known issues with interrupting a DC power circuit and to protect the components of the controller and system when turning system 10 to an "off" state, second set of contactors 28 are opened and first pair of contactors 32 are closed forming a third circuit, the third circuit including generator 24, third coil 35*c* of reactance element 34, and first pair of contactors 32. An example of the third circuit can be seen in FIG. 6 which shows the third circuit of system 10 in FIG. 1.

Figure 6:
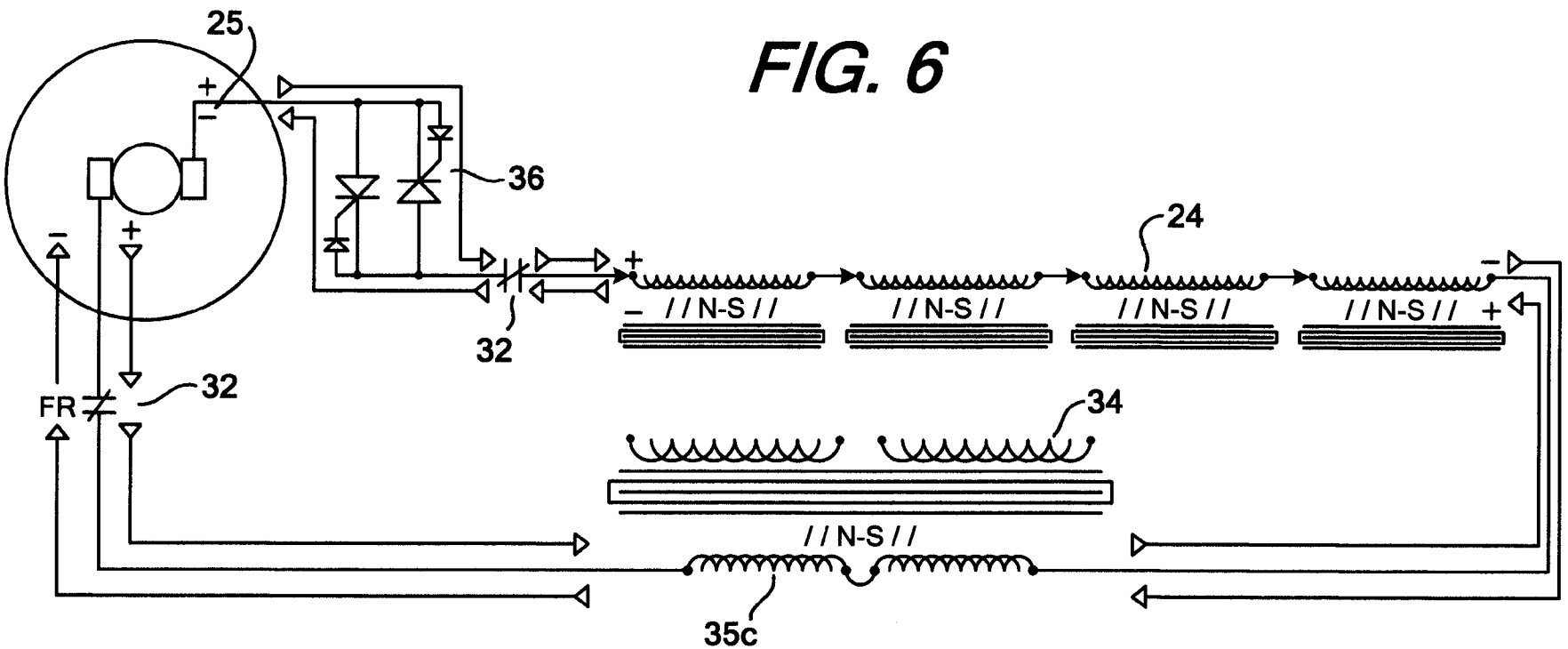
FIG. 6 is a schematic diagram showing a third circuit as contemplated by the embodiment shown in FIG. 1.

As seen in FIGS. 1 and 6, the third circuit may further include rectifier 36, which may be, for example, a dual-gated dual silicon controlled rectifier. When configured as shown in FIG. 1, utilizing rectifier 36 insures that any residual voltage or current applied to reactance element 34 and/or generator 24 from armature 25 during the "off" state is always in an opposite direction to that required to build a voltage across reactance element 34 and/or generator 24. Insuring that a voltage is built across reactance element 34 and/or generator 24 prevents armature 25 from generating excess voltage when in the "off" state, allowing all stored and/or created residual voltage to be efficiently negated and/or consumed by reactance element 34 and or generator 24. Rectifiers 20, 22, and 36 are inductively protected from instantaneous voltage spikes when system 10 is restarted.

In alternative embodiments, like for example those shown in FIGS. 2 and 3, first pair of contactors 32 may be configured in a manner where the third circuit includes first rectifier 20. Including first rectifier 20 may enhance the discharge of energy stored in the first circuit during the lift sequence, as the parasitic capacitance of first rectifier 20 will be discharged. In such embodiments, the first pair of contactors 32 may be closed at the end of the lift sequence, before the drop sequence begins.

In the embodiments shown in FIGS. 2 and 3, after closing pair of contactors 32, first set of contactors 18 may be opened allowing reactance element 34 to consume and/or negate the power stored in generator 24. Closing first pair of contactors 32 forms the third circuit wherein the third circuit includes rectifier 20, generator 24, reactance element 34, and first pair of contactors 32. Discharging the energy stored in generator 24 eliminates the issues associated with DC power circuit interruption and allows for the first circuit and system 10 to be opened, i.e. turned off or switched to a dropping sequence, without having to worry about arcing or damage to system components. Once the power stored in generator 24 is consumed and or negated, first pair of contactors 32 may be safely opened and the drop sequence may begin.

In the embodiment shown in FIGS. 2 and 3, once the lifted material has been dropped as described above, as with the lift sequence, in order to pick up additional magnetic material, or alternatively remove any residual magnetism from the dropped material, the power stored in and/or residual power created by generator 24 must be consumed and/or negated.

In the embodiments shown in FIGS. 2 and 3, second set of contactors 40 are provided to form a fourth circuit. In the embodiments shown in FIGS. 2 and 3, in order to discharge stored energy from and any residual voltage created by generator 24 (and second rectifier 22), second pair of contactors 36 is closed forming a fourth circuit, the fourth circuit including generator 24, reactance element 34 or 42, second pair of contactors 40. After closing second pair of contactors 40, second set of contactors 28 are opened allowing reactance element 38 (or 39) to consume the power stored in and/or created by generator 24. Once the power stored in generator 24 is consumed, second pair of contactors 36 can be safely opened and a new lift sequence can begin.

While in the foregoing there has been set forth a preferred embodiment of the invention, it is to be understood that the present invention may be embodied in other specific forms without departing from the spirit or central characteristics thereof. The present embodiments, therefore, are to be considered in all respects as illustrative and not restrictive, and the invention is not to be limited to the details given herein. While specific embodiments have been illustrated and described, numerous modifications come to mind without significantly departing from the characteristics of the invention and the scope of protection is only limited by the scope of the accompanying Claims.

I claim:

1. A controller for moving magnetic material, the controller comprising:

a first bridge rectifier;

a second bridge rectifier;

a reactance element;

a resistance element;

a first set of contactors capable of opening and closing a first circuit, the first circuit including the first bridge rectifier, the reactance element, and the resistance element;

a second set of contactors capable of opening and closing a second circuit, the second circuit including the second bridge rectifier; and a dual gated dual silicon controlled rectifier to facilitate the discharge of residual voltage when the first and second set of contactors are open.

2. The controller of claim 1 wherein the second circuit includes the reactance element.

3. The controller of claim 1 wherein the second circuit includes the resistance element.

4. The controller of claim 1 further comprising a second resistance element.

5. The controller of claim 4 wherein the second circuit includes the second resistance element.

6. The controller of claim 5 wherein the second circuit includes the second resistance element and the reactance element.

7. The controller of claim 1 further comprising at least one pair of contactors.

8. The controller of claim 7 wherein the at least one pair of contactors are capable of closing a third circuit, the third circuit including the reactance element.

9. The controller of claim 7 further comprising at least a second pair of contactors.

10. The controller of claim 9 wherein the second pair of contactors are capable of closing a fourth circuit, the fourth circuit including the reactance element.

11. The controller of claim 9 further comprising a second reactance element.

12. The controller of claim 11 wherein the second pair of contactors are capable of closing a fourth circuit, the fourth circuit including the second reactance element.

13. The controller of claim 1 wherein the reactance element is a control transformer.

14. The controller of claim 1 further comprising a transformer.

15. The controller of claim 1 further comprising an inverter.

16. A system for moving magnetic material, the system comprising:

a power supply;

a generator having an armature coupled to a magnet capable of lifting, moving, and dropping magnetic material;

a first set of contactors, the first set of contactors being configured to open and close a first circuit between the power source and the generator coupled to the magnet to start and stop a lifting sequence, wherein the first circuit includes a first bridge rectifier;

a reactance element; and a resistance element;

a second set of contactors, the second set of contactors, the second set of contactors being configured to open and close a second circuit between the power source and the generator coupled to the magnet to start and stop a dropping sequence, wherein the second circuit includes a second bridge rectifier; and at least one pair of contactors, the at least one pair of contactors being configured to open and close a third circuit, the third circuit including the reactance element and the generator.

17. The system of claim 16 wherein the power supply is a DC power supply.

18. The system of claim 17 further comprising a DC-to-AC converter connected to the DC power supply in series.

19. The system of claim 18 further comprising a transformer wherein a primary winding of the transformer is connected to the output of the DC-to-AC converter.

20. The system of claim 16 wherein the second circuit includes the resistance element.

21. The system of claim 16 further comprising a second resistance element, wherein the second circuit includes the second resistance element.

22. The system of claim 16 wherein the second circuit includes the reactance element.

23. The system of claim 16 further comprising at least a second pair of contactors, the second pair of contactors being configured to open and close a fourth circuit.

24. The system of claim 23 further comprising a second reactance element.

25. The system of claim 24 wherein the second circuit includes the second reactance element.

26. The system of claim 24 wherein the fourth circuit includes the second reactance element.

27. The system of claim 16 wherein the discharge circuit further includes at least one of the first bridge rectifier and the second bridge rectifier.

28. The system of claim 16 wherein the reactance element is a control transformer.

29. The system of claim 16 further comprising a dual gated dual silicon controlled rectifier connected to at least one of the contactors forming the pair of contactors.

30. A method of moving magnetic material, the method comprising the steps of:

closing a first set of contactors to complete a first circuit between a power source and a generator having an armature coupled to a magnet capable of lifting, moving, and dropping magnetic material to lift magnetic material;

lifting the magnetic material;

opening the first set of contactors;

closing a second set of contactors to complete a second circuit between the power source and the generator couple to the magnet to drop the magnetic material;

dropping the magnetic material;

opening the second set of contactors; and closing a pair of contactors to complete a third circuit between the generator and a reactance element.

31. The method of claim 30 further comprising the step of providing DC voltage from the power source.

32. The method of claim 31 further comprising the step of converting the DC voltage to AC voltage.

33. The method of claim 32 further comprising the step of stepping the AC voltage up or down using a transformer.

34. A method of moving magnetic material, the method comprising the steps of:

closing a first set of contactors to complete a first circuit between a power source and a generator having an armature coupled to a magnet capable of lifting, moving, and dropping magnetic material to lift magnetic material;

lifting the magnetic material;

closing a pair of contactors to complete a third circuit between the generator and a reactance element;

opening the first set of contactors;

discharging any remaining power in the generator;

opening the pair of contactors;

closing a second set of contactors to complete a second circuit between the power source and the generator coupled to the magnet to drop the magnetic material;

dropping the magnetic material;

closing a second pair of contactors to complete a fourth circuit between the generator and the reactance element;

opening the second set of contactors;

discharging any remaining power in the generator; and opening the pair of contactors.

35. The method of claim 34 further comprising the step of providing DC voltage from the power source.

36. The method of claim 35 further comprising the step of converting the DC voltage to AC voltage.

37. The method of claim 36 further comprising the step of stepping the AC voltage up or down using a transformer.

* * * * *